US005297794A

United States Patent [19]

Lu

[11] Patent Number: 5,297,794

[45] Date of Patent: Mar. 29, 1994

[54] GOLF CLUB AND GOLF CLUB HEAD

[76] Inventor: Clive S. Lu, 282 Newbridge Rd., Hicksville, N.Y. 11801

[21] Appl. No.: 4,546

[22] Filed: Jan. 14, 1993

[51] Int. Cl.[5] ..... A63B 53/08

[52] U.S. Cl. ..... 273/171; 273/167 F; 273/167 H

[58] Field of Search ..... 273/167 R-77 A, 273/77 R, 193 R, 194 R, 194 A, 194 B, 162 R, 186.2, 187.4

[56] References Cited

U.S. PATENT DOCUMENTS

| | | | |
|---|---|---|---|
| 690,940 | 1/1902 | Febiger | 273/170 |
| 873,423 | 12/1907 | Govan | 273/169 |
| 1,529,009 | 3/1925 | Carpenter | 273/169 X |
| 1,825,244 | 9/1931 | Nero | 273/170 |
| 2,067,556 | 1/1937 | Wettlaufer | 273/167 K |
| 2,163,091 | 6/1939 | Held | 273/171 |
| 2,360,364 | 10/1944 | Reach | 273/171 |
| 2,592,013 | 4/1952 | Curley | 273/170 |
| 2,750,194 | 6/1956 | Clark | 273/171 |
| 3,556,533 | 1/1971 | Hollis | 273/171 |
| 3,589,731 | 6/1971 | Chancellor | 273/170 |
| 3,606,327 | 9/1971 | Gorman | 273/171 |
| 3,897,066 | 7/1975 | Belmont | 273/171 |
| 3,961,796 | 6/1976 | Thompson | 273/167 A |
| 3,979,122 | 9/1976 | Belmont | 273/171 |
| 3,979,123 | 9/1976 | Belmont | 273/171 |
| 3,995,865 | 12/1976 | Cochran | 273/171 X |
| 4,085,934 | 4/1978 | Churchward | 273/171 |
| 4,180,269 | 12/1979 | Thompson | 273/171 |
| 4,214,754 | 7/1980 | Zebelean | 273/171 X |
| 4,319,752 | 3/1982 | Thompson | 273/167 H |
| 4,461,481 | 7/1984 | Kim | 273/170 |
| 4,607,846 | 8/1986 | Perkins | 273/167 H X |
| 4,655,458 | 4/1987 | Lewandowski | 273/171 X |
| 4,730,830 | 3/1988 | Tilley | 273/171 |
| 5,082,278 | 1/1992 | Hsien | 273/167 J X |

FOREIGN PATENT DOCUMENTS

| | | | |
|---|---|---|---|
| 2195546 | 4/1988 | United Kingdom | 273/167 R |

*Primary Examiner*—Vincent Millin
*Assistant Examiner*—Sebastiano Passaniti
*Attorney, Agent, or Firm*—King and Schickli

[57] ABSTRACT

A golf club includes a flexible shaft, a grip at a proximal end of the shaft and a club head at a distal end of the shaft. The club head includes a body portion and a weight. The weight furnishes at least twenty to twenty-five percent (20–25%) of the total club head mass and is mounted to the body portion so as to allow limited relative movement therebetween. Specifically, the weight is mounted directly behind the golf ball striking face of the body portion of the club head. The weight is preferably formed from at least two wedge-shaped blocks that may be oriented to shift weight toward the toe or heel as desired. When striking a golf ball, the golf ball striking face of the club head is interdisposed between the weight and the golf ball so as to prevent direct contact between the weight and ball thereby reducing the potential for spin application to the ball.

20 Claims, 2 Drawing Sheets

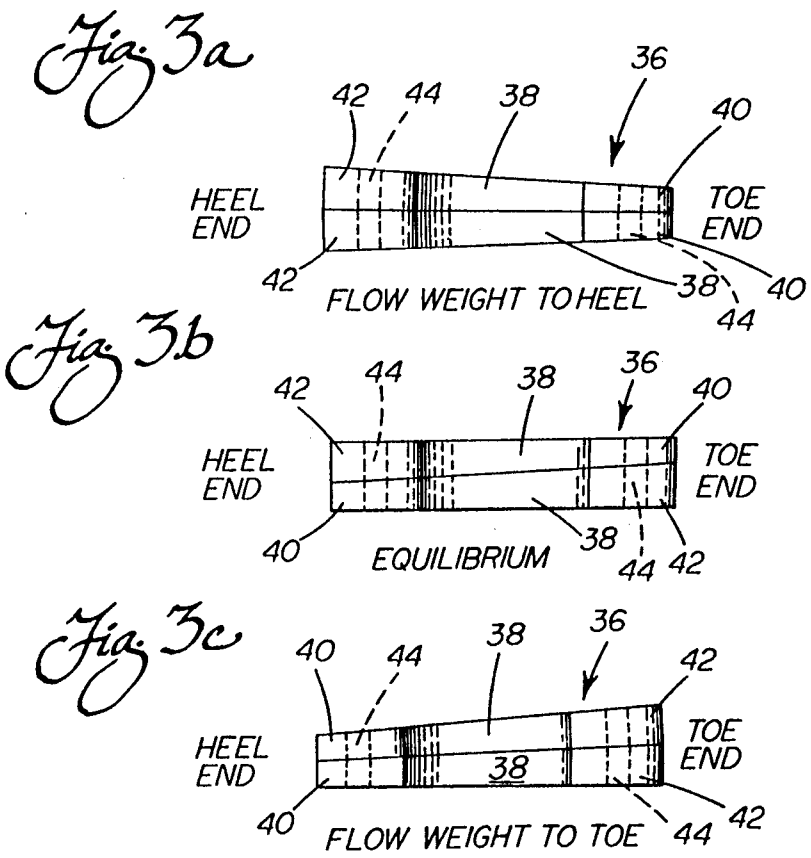
Fig. 3a
Fig. 3b
Fig. 3c
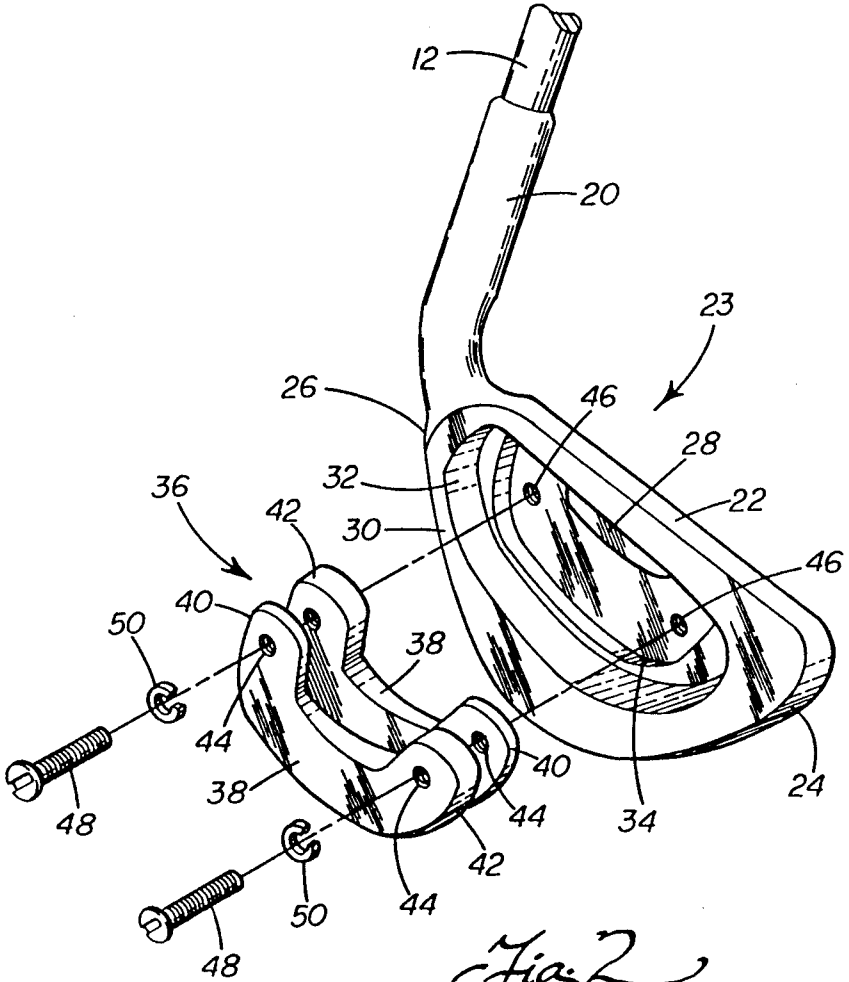
Fig. 2

GOLF CLUB AND GOLF CLUB HEAD

TECHNICAL FIELD

The present invention relates generally to the field of golf and, more particularly, to golf clubs of improved design including: (1) an integral weight system providing selective adjustability of heel-toe balance and (2) decoupling of a significant portion of the overall club head mass from direct contact with the golf ball so as to insure straighter, truer shot making.

BACKGROUND OF THE INVENTION

It has long been recognized by golf club manufacturers that the shot making characteristics of a golf club may be adjusted by altering the position of the center of gravity of the club or, in other words, changing the heel-toe balance. Such an adjustment effectively serves to move the "sweet spot" toward or away from the heel or toe so as to bring the club into conformance with the swing tendencies of the golfer. In this way it is possible to insure more consistent and efficient transfer of energy from the golf club to the golf ball and, accordingly, the production of longer, straighter shots. Of course, by reducing and in some cases eliminating undesired slicing and hooking of the golf ball, an individual may reduce his or her golf score and increase his or her enjoyment of the game.

Many of the prior art proposals for weight adjustment and, accordingly, the customizing of a golf club to one's swing, have been unsatisfactory for a number of reasons. For example, U.S. Pat. Nos. 3,897,066 to Belmont; 4,180,269 to Thompson; and 4,655,458 to Lewandowski disclose club heads provided with passages or reservoirs for receiving weighty material such as lead powder, tungsten powder and/or liquid mercury. Unfortunately, upon adding any of these weighty materials in varying proportions to adjust the heel-toe balance and compensate for a particular swing, the overall swing weight of the golf club is also altered. This alteration in the swing weight often affects the speed and swing path of the golfer, many times negating the corrective effect that would otherwise be produced or actually compounding the problem. Further, it should be appreciated that the weighty materials, because they are liquid or powder, freely move within the reservoirs even in directions not parallel to the swing path. This creates a sloshing or mushy feel not conducive to providing the desired feedback to the golfer when striking the ball to allow the best playability.

Other golf clubs with adjustable weighting representative of the prior art are disclosed in U.S. Pat. Nos. 3,979,122 to Belmont; 4,340,230 to Churchward; 4,607,846 to Perkins; and 5,082,278 to Hsien. In these patents, a number of weights of differing mass are provided with one or more being positioned in cavities or threaded bores as required to provide the desired heel-toe balance. Once again, it should be appreciated that the total swing weight of the golf club is often altered when making adjustments with these systems and this factor alone can hinder the actual provision of any corrective effect resulting from weight redistribution. It should further be appreciated that unused weights must be stored until needed. As it may be a year or more between weight adjustments, the stored weights have a tendency to be misplaced, lost or forgotten thereby rendering this type of weight adjustment system essentially inoperative unless new replacement weights are purchased.

In addition to these shortcomings, prior art golf clubs with weight adjustment systems have failed to address a number of other issues of concern. Specifically, none known to this inventor that have been developed to date may be effectively utilized with irons of "perimeter weighting" design while fully maintaining the advantages of perimeter weighting. Further, none include weights that form an integral part of the club head structure and that have an overall mass equal to or greater than the golf ball so as to provide the most efficient transfer of energy resulting in longer hitting distances. Many of the prior art weight adjustment systems also serve to move club head weight well away from the central portion of the striking face adjacent the sweet spot, outwardly toward the heel and/or toe area. This has the disadvantageous effect of reducing the lift and distance provided to the ball being hit. Additionally, none effectively provide a full measure of adjustment to compensate for slicing and hooking in the manner of the present invention as described in the following.

SUMMARY OF THE INVENTION

Accordingly, it is a primary object of the present invention to provide an improved golf club with an integral adjustable weight system overcoming the above-described limitations and disadvantages of the prior art.

Another object of the present invention is to provide a golf club for efficiently striking a golf ball that allows heel-toe weight adjustment while maintaining weight concentration around and under the "sweet spot" so as to allow shot making with improved lift, accuracy and resulting distance.

Yet another object of the invention is to provide a golf club with an adjustable weight that is an integral part of the club construction and must be in place to allow use of the club. Advantageously, the weight may be oriented to selectively position the center of gravity of the club toward or away from the heel or toe so as to allow adjustment of the swing characteristics of the club to counteract any tendency of a golfer to slice or hook. Advantageously, this is done while maintaining a constant swing weight so that the swing tendencies of the golfer are not altered and effective compensation may be made for the undesired tendency.

A still further object of the present invention is to provide a golf club with an adjustable weighting system wherein an air gap is provided between the weight and the rear of the wall of the club head forming the ball striking or front face. The air gap acts as a spring effectively creating a snap action at impact to provide better power and longer hitting distances.

Another object of the invention is to provide a club head wherein at least fifteen (15%) and preferably twenty to twenty-five percent (20–25%) of the overall club head weight is decoupled from direct contact with the golf ball at impact, thereby reducing the potential for application of slice and hook spin thereto. Accordingly, a truer or straighter line of golf ball flight is provided.

Still another object of the invention is to provide a golf club with a unique head that is particularly adapted to suppress overall vibration and thereby improve the "feel" to the golfer for purposes of improved playability.

Additional objects, advantages, and other novel features of the invention will be set forth in part in the description that follows and in part will become apparent to those skilled in the art upon examination of the following or may be learned with the practice of the invention. The objects and advantages of the invention may be realized obtained by means of the instrumentalities and combinations particularly pointed out in the appended claims.

To achieve the foregoing and other objects, and in accordance with the purposes of the present invention as described herein, an improved golf club is provided for efficiently striking a golf ball so as to allow shot-making with better accuracy and increased resulting distance. The golf club includes a flexible shaft that may be formed from stainless steel, graphite composite or other materials known to be suitable for this purpose. A grip of a type well known in the art and formed of, for example, rubber is connect to the proximal end of the shaft and is adapted to allow a golfer to properly hold the golf club. A club head is then connected to the distal end of the shaft.

Preferably, the club head is perimeter weighted in a manner known in the art thereby including a body portion having a front face wall for striking a golf ball and a centrally located cavity in the rear surface thereof. The club head body also includes a heel end adjacent to the point of connection to the shaft and an opposite, distal or toe end. Advantageously, it should be appreciated that the club head may be of either "iron" or "wood" design.

In accordance with the present invention, the club head also includes a weight. The weight is mounted to the body portion so as to allow for limited relative movement therebetween. Preferably, the weight is mounted in the cavity in the rear surface of the body portion so as to lie directly behind the front face wall.

Preferably, the weight includes at least two identical wedge-shaped blocks that are continuously varying in both thickness and cross sectional mass from a relatively thin end to an opposite, relatively thick end. Further, the blocks are preferably U-shaped so as to be adapted for concentrating mass around and under the sweet spot of the striking or front face. This insures that good lift and driving distance are imparted to the golf ball on any given swing. It should be appreciated that the blocks may be received in the cavity in one of three orientations. In a first of the orientations, the thick end of both blocks are aligned toward the toe end of the club head. Accordingly, the center of gravity of the club head is shifted toward the toe. Such a shift in weight distribution and the position of the sweet spot tends to overcome the tendency of a right-handed golfer to slice the ball.

In the second orientation, the thick end of both blocks are aligned toward the heel end of the club head so as to shift the center of gravity and sweet spot toward the heel. Such weight redistribution tends to overcome the tendency of a right-handed golfer to hook the ball.

Finally, in the third orientation, the thin end of one block and the fat end of another block are aligned adjacent both the toe and heel ends of the club head. Accordingly, the center of gravity is shifted to a central location directly between the heel and toe. In this position no adjustment is made to counteract the tendency to slice or hook.

In accordance with yet another aspect of the present invention, the blocks each include matching apertures. Fasteners are provided to pass freely through the apertures and engage the body portion of the club head so as to secure the blocks in the cavity. Preferably the fasteners are equipped with resilient lock washers that both prevent the fasteners from backing out and also maintain some play between the blocks and the front face wall of the club head. More specifically, an air gap is formed and functions in conjunction with the resilient lock washers as a spring during the swinging of the club head. Specifically, during the downswing the blocks are positioned back from the front face wall so that an air gap of approximately $10^{-3}$ to $10^{-6}$ inches in thickness exists between the blocks and that wall. As the club head strikes the golf ball, the blocks snap forward forcing air from the gap thereby engaging the wall and transferring energy to the golf ball to drive it forward.

Preferably, the blocks have a combined mass at least as great as or greater than the golf ball (at least 45–50 grams) so as to insure an efficient transfer of energy and less recoil. It should be appreciated, however, that what recoil is provided is out of phase with vibration produced by the striking of the club head against the golf ball. As a result, an overall cancellation of vibration takes place and less vibration is transmitted through the shaft and grip to the hands of the golfer. Thus, feel and playability are improved.

It should also be appreciated that the front face wall is effectively interdisposed between the wedges and the golf ball. As the blocks make up a significant total of the overall weight of the club head, between approximately at least fifteen (15%) and more preferably twenty and twenty-five percent (20–25%), the front face wall effectively decouples a significant portion of the mass of the club head from direct contact with the ball thereby reducing the potential for application of slice/hook spin to the ball. Accordingly, a truer, straighter line of flight results. This effective decoupling action is simply not provided in prior art adjustable weight golf club designs to any such significant extent.

Still other objects of the present invention will become readily apparent to those skilled in this art from the following description wherein there is shown and described a preferred embodiment of this invention, simply by way of illustration of one of the modes best suited to carry out the invention. As it will be realized, the invention is capable of other different embodiments, and its several details are capable of modifications in various, obvious aspects all without departing from the invention. Accordingly, the drawing and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. In the drawing:

FIG. 2 is a detailed rear perspective view of the club head of the golf club shown in FIG. 1 illustrating the cooperating removable/adjustable wedge-shaped blocks and showing the indented relief in which they are received in the cavity in the rear surface of the club head;

FIG. 3*a* is a top plan view showing the stacking of the blocks to shift the center of gravity of the club head toward the heel end;

FIG. 3*b* is a view similar to 3*a* but showing the stacking of the blocks to shift the center of gravity toward the toe end of the club head;

FIG. 3*c* is a view similar to FIGS. 3*a* and 3*b* but showing the stacking of the blocks to provide an equilibrium condition and the shifting of the center of gravity of the club head toward an intermediate, centerline position;

Reference will now be made in detail to the present preferred embodiment of the invention, an example of which is illustrated in the accompanying drawing.

DETAILED DESCRIPTION OF THE INVENTION

Figure 1:
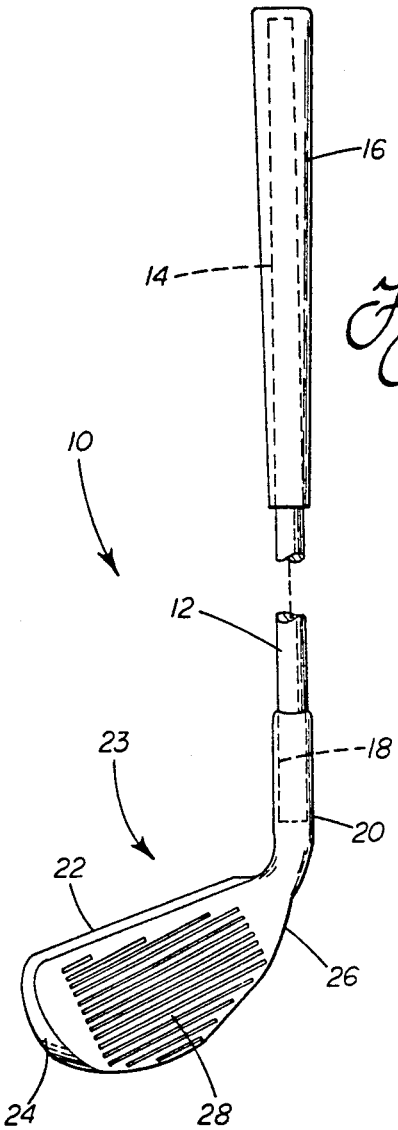
FIG. 1 is a partially cut-away, front elevational view of a golf club of the "iron" type constructed in accordance with the teachings of the present invention.
Figure 4:
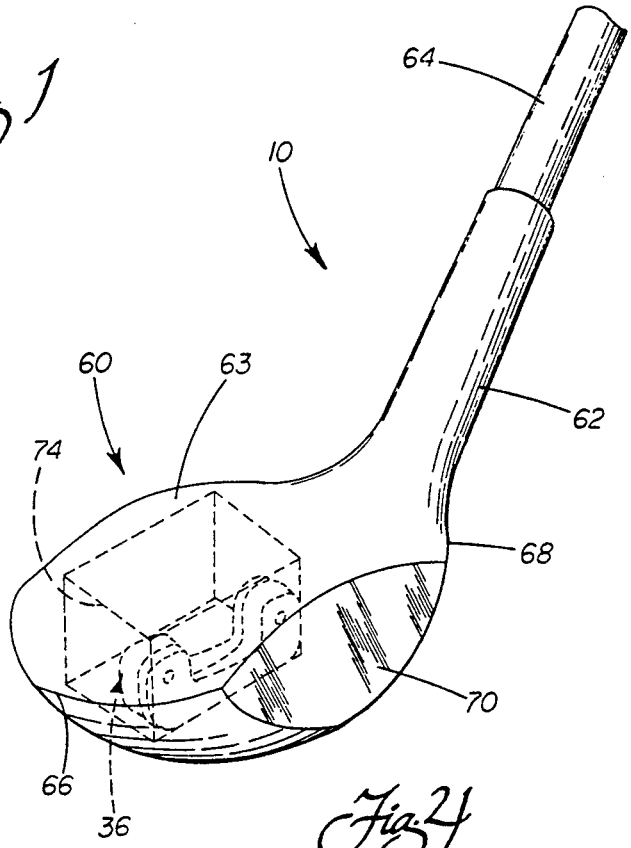
FIG. 4 is a front perspective view of a golf club of the "wood" type constructed in accordance with the teachings of the present invention.

Reference is now made to the drawing figures showing the improved golf club 10 of the present invention. As shown in FIG. 1, the golf club 10 may be of the "iron" type. Alternatively, as shown in FIG. 4 the golf club 10 may also be of the "wood" type.

As shown with reference to FIG. 1, the golf club 10 includes a shaft 12 of appropriate flexibility formed from titanium, graphite/boron, stainless steel or other appropriate material known in the art. The shaft 12 includes a proximal end 14. A handle or grip 16 of a type of construction known in the art is received over and mounted to the proximal end 14 of the shaft 12. The shaft 12 also includes a distal end 18 that is received and fixed in the hosel 20 of the body portion 22 of the club head 23.

The body portion 22 includes a toe end 24 and a heel end 26 adjacent to the shaft receiving hosel 20. The body portion 22 also includes a wall 28 defining a front face for striking a golf ball. As best shown in FIG. 2, the body portion 22 of club head 23 further includes a rear surface 30 including a primary cavity 32 so as to provide perimeter weighting in a manner known in the art. As should also be appreciated from reviewing FIG. 2, an indented relief or recess 34 is provided in the primary cavity 32. The relief 34 is substantially U-shaped so as to substantially correspond in shape to, but also provide the necessary clearance to receive a multi-piece weight 36.

As shown, the weight 36 comprises at least two identical, U-shaped blocks 38. Each of the blocks 38 is continuously varying in cross-section in a lateral direction so as to also have a wedge-shape. Thus, each of the blocks 38 varies in both mass and thickness from a relatively thin end 40 to a relatively thick end 42. Accordingly, it should be appreciated that by varying the orientation of the blocks 38 it is possible to shift the center of gravity of the club head in a selective manner to one of three positions. In this way it is advantageously possible to compensate for swing errors and reduce the tendency of an individual golfer to slice or hook the golf ball while maintaining a constant swing weight. Further, this is achieved while maintaining a relatively simple structure wherein all the necessary weights for adjustment are always utilized and mounted to the golf club head 22. Accordingly, weights will not be misplaced and lost in a manner common to prior art designs. Further, as the blocks 38 are mounted within the relief 34 in a single position no matter which of the three orientations is selected, a single mounting system is all that is required. This advantageously simplifies production and reduces production costs.

With particular reference to FIGS. 3*a*–3*c*, the three orientations of the blocks 38 and the resulting compensation for swing errors will now be described.

As shown in FIGS. 3*a* and 3*b*, the two blocks 38 may be stacked so as to provide both of the higher mass, thicker ends 42 on one side and both of the lower mass, thinner ends 40 on the other side. Where the blocks 38 are then positioned in the relief 34 in the rear surface 30 of the body portion 22 with both of the thicker ends 42 toward the heel 26, a shift in the center of gravity of the club head 23 is produced toward the heel. Such a shift in weight distribution tends to overcome the tendency of a right-handed golfer to hook the golf ball. Alternatively, the two thicker ends 42 of the blocks 38 may be positioned in the relief 34 toward the toe end 24 of the club head 23. This tends to shift the center of gravity of the club head 23 toward the toe 24. Such a shift in weight distribution tends to overcome the tendency of a right-handed golfer to slice the golf ball.

FIG. 3*c* shows the stacking of the blocks 38 so that the relatively thin end 40 of one block is stacked against the relatively thick end 42 of the other block. As a result of this orientation, the blocks 38 provide an even or equilibrium weight distribution. When the blocks 38 are positioned into the relief 34 in this orientation, the center of gravity is shifted toward a relatively intermediate, centerline position.

Of course, it should be appreciated that the orientation of the blocks 38 is selected in accordance with the needs of the individual golfer. Thus, a golfer prone to slice will position the blocks 38 with the two relatively thick ends 42 toward the toe 24 so as to provide the necessary shift in weight distribution to tend to overcome the tendency to slice the ball. In contrast, a golfer prone to hook will orient the blocks 38 in the opposite manner with the relatively thick ends 42 position in relief 34 toward the heel 26 of the club head 23. This provides a shift in the weight distribution and tends to overcome the tendency of the right-handed golfer to hook the ball. Finally, where the golfer has no tendency to slice or hook, equilibrium weighting is desired and, accordingly, the blocks 38 are position in the relief 34 so that one relatively thin end 40 and one relatively thick end 42 is provided toward each of the toe end 24 and heel end 26 of the club head 23.

No matter the orientation of the blocks 38, the mounting of the blocks in the relief 34 is always the same. Specifically, each of the blocks 38 includes aligned matching apertures 44 adjacent to each end. Aligned, cooperating threaded apertures 46, having a blind bore, are also provided in the front face wall 28 of the body portion 22. Thus, after the positioning of the blocks 38 in the relief 34, a pair of screws 48 are extended through resilient lock washers 50 and apertures 44 and threadedly engaged in the apertures 46. The screws 48 are then tightened down sufficiently to secure the blocks 38 in position.

It should be appreciated that the screws 48 pass freely through the apertures 44 in the blocks 38. Further, the, resilient lock washers 50 ensure that limited play, remains between the heads of the screws 8, the blocks 38 and the bottom of the relief 34 formed by the rear of the front face wall 28. Thus, relative movement is allowed between the blocks 38 and the body portion 22 of the club head 23. This relative movement is, however, advantageously substantially limited by the "guide" screws 48 and their engagement in the apertures 44 to a direction along/parallel to the swing path (e.g. perpendicular to the face wall 28) of the golf club 10 when striking a golf ball. Thus, efficient energy storage and transfer are provided as wanted lateral vibration that drains stored energy and produces undesirable "mushy feel" is minimized. As a result of all these features, it should be appreciated that the air gap that is formed functions in conjunction with the resilient nature of the lock washers 50 in the manner of a spring during the swinging of the golf club.

Accordingly, during the downswing of the golf club 10, the blocks 38 are forced back from the wall 28 against the lock washers 50 and the heads of the screws 48 so that an air gap of approximately $10^{-3}$ to $10^{-6}$ inches in thickness exists between the blocks and the wall. As the front face wall 28 of the club head 22 strikes the golf ball, the blocks 38 snap forward. As air is forced from the gap, a microsecond delay occurs between the impact of the front face wall 28 of the body portion 22 with the golf ball and the impact of the blocks 38 with that wall. As the wedges 38 engage the wall 28 energy is transferred from the blocks to the golf ball, which is still in contact with the front face 28, to drive it forward.

As the blocks 38 have a combined mass at least as great or greater than the golf ball, efficient transfer of energy to the golf ball is provided so as to maximize driving distance. Further, it should be appreciated that the front face wall 28 is effectively interdisposed between the blocks 38 and the golf ball at impact. As the blocks 38 make up a significant total (e.g. at least 45–50 grams) of the overall mass "M" of the club head 23 (e.g. 235–299 grams), between approximately twenty to twenty-five (20–25%) percent (0.02 to 0.25"M"), the front face effectively decouples a significant portion of the mass of the club head from direct contact with the golf ball. This advantageously serves to reduce the potential for application of slice/hook spin to the ball. A straighter line of flight results.

Accordingly, it should be appreciated that the present invention not only advantageously allows the selective shifting of the weight distribution of the club head 23 to compensate for swing errors and the tendency of a golfer to slice or hook, but additional relief in the form of a reduction of the application of spin to the golf ball is also provided. This surprising, synergistic effect results in the production of a golf club that is more forgiving of swing errors and that will, accordingly, improve the game of many golfers.

An additional further advantage is produced by the golf club 10 of the design shown. Specifically, the snap action of the blocks 38 and the micro-second delay produced as a result of the forcing of air from the gap, as described, functions to reduce the vibration transmitted from the club head 23 through the shaft 12 and grip 16 to the golfer. More specifically, the impact of the club head face 28 with the golf ball produces a first vibration in the club head body portion 22. Similarly, the impact of the blocks 38 with and the recoil of the wedges from the wall 28 produces a second vibration in the club head body portion 22. These two vibrations are out-of-phase with one another as a result of the microsecond delay produced by the air gap. Thus, the two vibrations have a tendency to cancel thereby reducing the overall vibration that is transmitted to the golfer. This serves to improve the golfers feel so as to allow better shot making and greater confidence when striking the golf ball. This leads to improved performance and significant player satisfaction.

Figure 5:
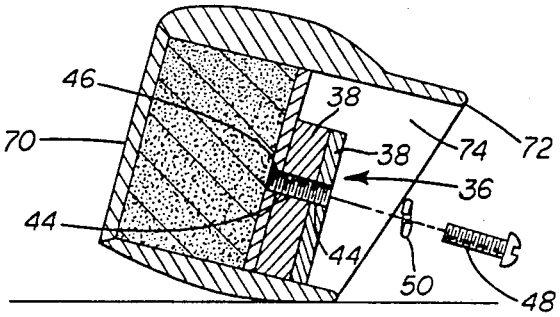
FIG. 5 is a sectional view of the club head shown in FIG. 4 illustrating the mounting of the blocks in accordance with the teachings of the present invention.

All the advantages described above with respect to utilization of the golf club 10 of the present invention of the "iron" type are also provided in golf clubs of the present invention of the "wood" type. More specifically, a wood type golf club 10 of the present invention is shown with perimeter weighting in FIGS. 4 and 5. As shown, the golf club 10 includes a head 60 including a hosel 62 for receiving and mounting on a shaft 64. Like the "iron" type club head 23, the head 60 also includes a body portion 63 having a toe end 66, a heel end 68, a front face 70 for engaging a golf ball and a rear surface 72 including a cavity 74.

Substantially U-shaped blocks 38 of the type described above are mounted in the cavity 74 in any of the three orientations desired by means of screws 48 and lock washers 50. The mounting arrangement is identical to that described with respect to the "iron" type of golf club 10 so as to function in the same manner and provide the same desirable results. The only significant difference is in the structure of the head 60 itself. Specifically, the body portion 63 comprises a three-piece, welded hollow metal housing, preferably formed from stainless steel or other appropriate material by the investment casting method. The hollow cavity within the body portion 63 may be filled with a foam material such as polyurethane in the manner known in the art.

In summary, numerous benefits result from employing the concepts of the present invention. A golf club 10 is provided wherein the adjustable weight 36 is a significant percentage, between fifteen (15%) and more preferably twenty and twenty-five percent (20–25%), of the total mass of the club head. Accordingly, the weight 36 is an integral part of the club head that must be mounted in position to provide the required structural integrity and swing weight to utilize the golf club. Additionally, the weight 36 is mounted for relative movement with respect to the body portion 22 of the club head 23 behind the ball striking face 28, Thus, the weight snaps forward to transfer energy momentarily after impact of the body portion 22 of the club head 23 with the golf ball. When this occurs the interdisposed wall 28 of the body portion 22 prevents direct contact between the weight 36 and the ball. As a result of this decoupling the potential application of slice or hook causing spin is reduced. Accordingly, a truer, straighter shot is produced to improve the golfers accuracy.

Additionally, as the mass of the weight 36 is at least equal to or greater than the golf ball, energy is efficiently transferred from the weight to the golf ball so as to ensure maximum driving distance. As a further advantage, vibration transferred to the golfer is reduced thereby allowing better feel. Additionally, the weight 36 is formed by two identical wedge-shaped blocks 38 that may be oriented in one of three ways to allow the shifting of the center of gravity of the golf club to compensate for the golfers tendency to slice or hook. Further, this is achieved while providing a single mounting position so as to simplify production requirements.

The foregoing description of a preferred embodiment of the invention has been presented for purposed of illustration and description. It is not intended to be exhaustive or to limit the invention to the precise form disclosed. Obvious modifications or variations are possible in light of the above teachings. For example, wedge-shaped block sets of varying mass may be provided so as to allow the golfer the option to change golf club swing weights. The embodiment was chosen and described to provide the best illustration of the principles of the invention and its practical application to thereby enable one of ordinary skill in the art to utilize the invention in various embodiments and with various modifications as suited to the particular use contemplated. All such modifications and variations are within the scope of the invention as determined by the appended claims when interrupted in accordance with the breadth to which they are fairly, legally and equitably entitled.

I claim:

1. A golf club for efficiently striking a golf ball so as to allow shot making with improved accuracy and resulting distance, comprising:

a flexible shaft having a proximal end and a distal end;

a grip, connected to said proximal end of said shaft, for holding said golf club;

a club head connected to said distal end of said shaft, said club head having a toe end, a heel end adjacent said shaft, a center of gravity between said toe end and heel end, a centrally located cavity in a rear surface thereof so as to provide perimeter weighting and a front face for striking a golf ball;

said golf club being characterized by an integral and adjustable multi-piece weight received in said cavity at a single mounting position behind said front face, said multi-piece weight being selectively mounted in one of three orientations with each of said orientations individually allowing for a shifting of the center of gravity of said club head respectively toward, the toe end, toward the heel end or toward an intermediate, centerline position.

2. The golf club set forth in claim 1, wherein said multi-piece weight includes at least two identical wedge-shaped blocks, each of said blocks continuously varying in both mass and thickness from a relatively thin end to an opposite, relatively thick end whereby when said blocks are in the first of said orientations said thick end of both blocks are aligned toward said toe end so as to shift the center of gravity of said club head toward said toe end; in the second of said orientations said thick end of both blocks are aligned toward said heel end so as to shift the center of gravity of said club head toward said heel end; and in the third of said orientations the thin end of one block and the thick end of another block are aligned toward both the toe and heel ends so as to shift the center of gravity of said club head toward said intermediate centerline position directly between said heel and toe ends.

3. The golf club set forth in claim 2, wherein said blocks each include matching apertures and fasteners are provided that pass freely through said apertures and engage said club head so as to secure said blocks in said recess while maintaining limited play between said blocks and said club head to allow relative movement therebetween.

4. The golf club set forth in claim 3, wherein said blocks have a mass equal to or greater than the golf ball being struck with said golf club.

5. The golf club set forth in claim 3, wherein said blocks have a mass comprising between 15–25% of the total weight of said club head and are required to be in said cavity to maintain the swing weight and the structural integrity of said club head.

6. The golf club set forth in claim 3, wherein said blocks are substantially U-shaped.

7. The golf club set forth in claim 1, wherein said weight has a mass equal to or greater than the ball being struck by said club.

8. A golf club for efficiently striking a golf ball so as to allow shot making with improved accuracy and resulting distance, comprising:

a flexible shaft having a proximal end and a distal end;

a grip, connected to said proximal end of said shaft, for holding said golf club;

a club head, connected to said distal end of said shaft, said club head including a body portion and a weight, said body portion and weight having an overall mass M with said weight having a mass of at least 0.15 M;

means for mounting said weight on said body portion while providing limited relative movement therebetween; and means for decoupling said weight from direct contact with the golf ball during striking of the golf ball whereby the potential for applying hook or slice spin to the golf ball is substantially reduced.

9. The golf club set forth in claim 8, wherein said weight has a mass of at least 0.25 M.

10. The golf club set forth in claim 8, wherein said club head has a mass of substantially 235–299 grams and said weight has a mass of at least 45 grams.

11. The golf club set forth in claim 8, wherein said weight comprises at least two wedge-shaped blocks, each of said blocks continuously varying in both mass and thickness from a relatively thin end to an opposite, relatively thick end; said blocks being mounted on said body portion in one of three orientations; in the first of said orientations said thick end of both blocks are aligned toward said toe end so as to shift the center of gravity of said club head toward said toe end; in the second of said orientations said thick end of both blocks are aligned toward said heel end so as to shift the center of gravity of said club head toward said heel end; and in the third of said orientations the thin end of one block and the thick end of another block are aligned toward both the toe and heel ends so as to shift the center of gravity of said club head toward an intermediate, centerline position directly between said heel and toes ends.

12. The golf club set forth in claim 11, wherein said blocks each include matching apertures and fasteners are provided that pass freely through said apertures and engage said body portions of said club head so as to secure said blocks in position while maintaining limited play between said blocks and said body portion to allow relative movement therebetween.

13. The golf club set forth in claim 12, wherein said blocks are substantially U-shaped.

14. The golf club set forth in claim 8, wherein said body portion includes a wall forming a ball striking face and said weight is mounted to said body portion behind said wall whereby said wall is interdisposed between said weight and said golf ball when striking said golf ball with said golf club.

15. A head for a golf club, comprising:

a body portion having a mass M;

a weight having a mass of at least 0.15 M;

means for mounting said weight to said body portion while providing limited relative movement therebetween; and means for decoupling said weight from direct contact with a golf ball during striking of the golf ball whereby the potential for applying hook or slice spin to the ball is substantially reduced.

16. The golf club set forth in claim 15, wherein said weight has a mass of at least 0.25 M.

17. The golf club set forth in claim 15, wherein said club head has a mass of substantially 235–299 grams and said weight has a mass of at least 45 grams.

18. The golf club set forth in claim 15, wherein said weight comprises at least two wedge-shaped blocks, each of said blocks continuously varying in both mass and thickness from a relatively thin end to an opposite, relatively thick end; said blocks being mounted on said body portion in one of three orientations; in the first of said orientations said thick end of both blocks are aligned toward said toe end so as to shift the center of gravity of said club head toward said toe end; in the second of said orientations said thick end of both blocks are aligned toward said heel end so as to shift the center of gravity of said club head toward said heel end; and in the third of orientations the thin end of one block and the thick end of another block are aligned toward both the toe and heel ends so as to shift the center of gravity of said club head toward an intermediate, centerline position directly between said heel and toes ends.

19. The golf club set forth in claim 18, wherein said blocks each include matching apertures and fasteners are provided that pass freely through said apertures and engage said body portions of said club head so as to secure said blocks in position while maintaining limited play between said blocks and said body portion to allow relative movement therebetween.

20. The golf club set forth in claim 15, wherein said body portion includes a wall forming a ball striking face and said weight is mounted to said body portion behind said wall whereby said wall is interdisposed between said weight and the golf ball when striking the golf ball with said golf club.

* * * * *